US006543437B1

(12) United States Patent
Luu et al.

(10) Patent No.: US 6,543,437 B1
(45) Date of Patent: Apr. 8, 2003

(54) DRAFTHOOD ADAPTER ASSEMBLY PARTICULARLY FOR STOVES AND FIREPLACES

(75) Inventors: Duong Luu, Mississauga (CA); Huynh Hy Co, Mississauga (CA); Patrick Kelly, Orangeville (CA); Thomas J. Beal, Ossian, IN (US)

(73) Assignee: CFM Corporation, Mississauga (CA)

( * ) Notice: Subject to any disclaimer, the term of this patent is extended or adjusted under 35 U.S.C. 154(b) by 0 days.

(21) Appl. No.: 09/710,291

(22) Filed: Nov. 10, 2000

(51) Int. Cl.[7] ..... F23L 17/04
(52) U.S. Cl. ..... 126/85 B; 126/307 R
(58) Field of Search ..... 126/85 B, 307 R, 126/312, 314, 512

(56) References Cited

U.S. PATENT DOCUMENTS

| | | | | |
|---|---|---|---|---|
| 2,745,397 A | | 5/1956 | Levin | |
| 2,811,095 A | | 10/1957 | Moran | |
| 3,691,930 A | * | 9/1972 | Steinman | 126/307 R |
| 3,874,363 A | | 4/1975 | Biedenbender et al. | |
| 4,757,802 A | * | 7/1988 | Guzorek | 126/312 |
| 4,924,850 A | | 5/1990 | Rieger | |
| 5,012,793 A | * | 5/1991 | Guzorek | 126/307 R |
| 5,267,552 A | | 12/1993 | Squires et al. | |
| 5,303,693 A | | 4/1994 | Schroeter et al. | |
| 5,307,801 A | | 5/1994 | Schroeter et al. | |
| 5,377,666 A | | 1/1995 | Whitehouse | |
| 5,542,407 A | | 8/1996 | Hawkinson | |
| 5,839,428 A | | 11/1998 | Schroeter et al. | |
| 5,997,295 A | | 12/1999 | Mattson et al. | |

OTHER PUBLICATIONS

Three (3) Photographs of drafthood assembly manufactured by Napolean.

* cited by examiner

*Primary Examiner*—Sara Clarke
(74) *Attorney, Agent, or Firm*—Baniak Pine & Gannon

(57) ABSTRACT

A drafthood assembly for inclusion within a vent stack for a direct venting stove or fireplace, converting the direct venting stove or fireplace for use with a natural venting flue. The assembly includes an air intake section for feeding ambient room air into the combustion chamber and an exhaust gas section for feeding ambient room air into the products of combustion that are exhausted from the combustion chamber in order to cool the exhaust gas products so that a B-vent type flue can be used to carry the exhaust gas products out of the dwelling.

24 Claims, 3 Drawing Sheets

DRAFTHOOD ADAPTER ASSEMBLY PARTICULARLY FOR STOVES AND FIREPLACES

BACKGROUND OF THE INVENTION

1. Field of the Invention

The present invention generally relates to an air directing apparatus for use with appliances such as fuel consuming stoves or fireplaces, and particularly those which operate as a direct venting unit, and more particularly to converting direct venting stoves or fireplaces into natural venting (B vent) units without necessarily modifying any structural part of the stove or fireplace.

2. Description of the Prior Art

Various types of decorative fireplaces and stoves are very popular, typically providing a desired aesthetic effect but often for use as either a secondary heating means in a particular room of a house or as the primary heating means, such as in small cabins or resort homes. Gas fireplaces and stoves continue to gain in popularity. In general, these fireplaces are freestanding as well as built-in units, largely of sheet metal parts and glass, and prefabricated for ready installation in new or existing buildings. Stoves are typically cast metal and freestanding in nature. While the installation of a pre-fabricated fireplace and/or stove can avoid the high expense of installing a masonry fireplace, an issue to address is that there are usually only two operational types of flues to choose from: direct venting units and natural venting units.

The direct venting units are sealed units, meaning that such fireplaces and stoves have sealed combustion chambers that are connected to external venting means for venting the products of combustion (POC's), while the oxygen needed for the combustion process is provided by supplying outside air from an air source located outside the home. The air is drawn into the combustion chamber generally by the draft created from the hot POC's rising within the vent stack. These direct venting devices typically bum natural gas or propane gas, and the combustion air introduced and the hot POC's exhausted are maintained separate from each other, although generally travel through concentric tubes or closely adjacent conduits.

A perceived downside of the direct venting arrangement is that a negative pressure in the POC (exhaust) vent stack will directly affect the drafting or suction of the outside air that is to be introduced into the combustion chamber for burning of the fuel. This means that the hotter the exhaust vent stack gets, the greater the negative pressure will exist inside the vent stack and the faster the hot POC's will be exhausted up the vent stack. The greater the draft created by the hot gases, the faster the outside combustion air will be sucked into the combustion chamber. However, outside pressure conditions can have a large effect on maintaining balanced operation. For instance, windy conditions can create resistive pressures which the exhaust gas pressure must then overcome, in the extreme, potentially causing a backup of combustion gases, which in turn may prevent combustion air to be adequately sucked into the combustion chamber and lead to an insufficient amount of oxygen to stoichiometrically fuel the fire.

With a natural venting fireplace or stove, openings found on the bottom of the unit provide inlet openings for allowing the air that is needed for combustion to be directly supplied from the ambient room air that surrounds the stove or fireplace. The exhaust gases are vented through a vent stack (e.g., chimney pipe, B-vent type) where the exhausting of hot POC's is generally carried on independently of the air introduction process, i.e., no "balanced flue" is created. However, with a natural venting operation, there are external factors which might affect this flow. For instance, the home may have other devices which can collectively increase the negative pressure within the house, or a positive pressure gradient may otherwise exist between outside air pressure and the interior air, i.e., a backdraft condition. Those other devices which may increase negative pressure could be a kitchen and bathroom exhaust fan, or a whole-house attic fan.

Favorably, the natural venting stove or fireplace is economically less expensive to purchase and install, because the temperatures at which the POC's are exhausted are generally much lower than that of a direct venting unit, meaning that an uninsulated or little insulated vent stack could be used.

Ideally, it would be desirable in some instances to combine the benefits of a direct vent unit with those of a natural venting arrangement, and thereby also overcome the difficulties mentioned above. Further, where a natural or B-vent is already present in an existing structure, an adapter to accommodate a direct vent-type unit would also be desirable.

SUMMARY OF THE INVENTION

It is a principal object of the invention to provide an apparatus enabling a direct vent appliance, such as a freestanding fireplace or stove, located in a room to operate with a natural vent flue that includes a vent stack for exhausting products of combustion (POC's) from a combustion chamber of the appliance. The object is met in the present invention with an apparatus comprising a drafthood assembly insertable into the natural vent stack, having an air intake section and an exhaust gas section, each section fluidly isolated from the other, wherein the air intake section introduces air in the room into the direct vent appliance for combustion and the exhaust gas section introduces air in the room into the vent stack to cool POC's exhausted from the appliance.

It is also a principal object of the invention to provide a drafthood assembly of the foregoing type in the form of an adapter that can be used with an existing direct vent appliance, such as one of a freestanding nature, to convert it for use with an existing natural vent stack.

One embodiment of the drafthood assembly further comprises a hollow cylindrical shell having an interior cavity, with the shell generally concentrically arranged about the exhaust pipe so as to define an annular passageway between the shell and exhaust pipe. A deflector is inserted within the passageway dividing the passageway to form the air intake section and the exhaust gas section, the air intake section being located below the exhaust gas section. In this embodiment, the cylindrical shell includes two sets of longitudinally spaced air inlet openings, one set of openings located above the deflector and the other set located below the deflector, each set of openings conducting ambient air in the room into the respective air intake and exhaust gas sections. Advantageously, air that enters the intake section initially contacts the exhaust pipe to become preheated prior to input within the combustion chamber.

It is another object in a preferred form of the invention to provide an exhaust gas section that has a first part and a second part, whereupon in the first part, the air that enters the drafthood assembly through the upper air inlet opening initially contacts the exhaust pipe to cool the exhaust pipe, thereby cooling POC's within the exhaust pipe, and whereupon in the second part, the air from the first part continues upwardly therein and mixes with the POC's prior to entry into the vent stack.

In this preferred form, the hollow exhaust pipe has first and second open ends corresponding to and generally coextensive with the top and bottom ends of the shell, the top end of the shell having a transition assembly secured thereabout. The transition assembly defines the second part of the exhaust section, with the transition assembly forming a mixing area where air mixes with the POC's exiting the exhaust pipe, thereby cooling the POC's. The transition assembly in one embodiment comprises a reducer having a top and a bottom end, and an upper exhaust pipe extension having a top and a bottom end. The bottom end of the upper exhaust pipe extension is connected to the top end of the reducer, the reducer spanning the annular passageway and forming a neck for directing air into the second part in the upper exhaust pipe.

A sensor assembly that projects into the first part of the exhaust gas section may further be provided, the sensor assembly measuring the temperature of the POC's and serving as a fuel cut-off under certain circumstances.

The features and advantages of the invention will be further understood upon consideration of the following detailed description of an embodiment of the invention taken in conjunction with the drawings, in which:

DETAILED DESCRIPTION OF A PREFERRED EMBODIMENT

Figure 2:
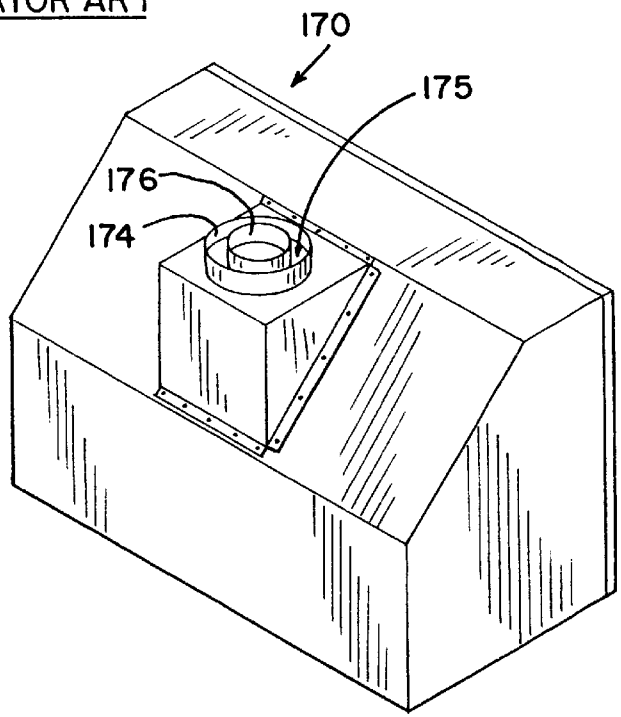
FIG. 2 PRIOR ART
FIG. 2 is a rear isometric view of the fireplace of FIG. 1 showing a vent stack location for connection to a flue.

For purposes of promoting and understanding the principles of the drafthood assembly 10 of the present invention, reference will now be made to an embodiment illustrated in the drawings, and specific language will be used to describe the same. It will nevertheless be understood that no limitation of the scope of the invention is thereby intended, there being contemplated such alterations and modifications of the illustrative device, in such further applications of the principles of the invention as discussed herein, as would normally occur to one skilled in the art to which the invention pertains. For instance, while the invention is described hereafter in the environment of a freestanding fireplace or stove, i.e., a unit that is not built into the wall and/or has a vent pipe/stack in the room, other direct-vent type appliances could benefit from employment of the invention.

Figure 1:
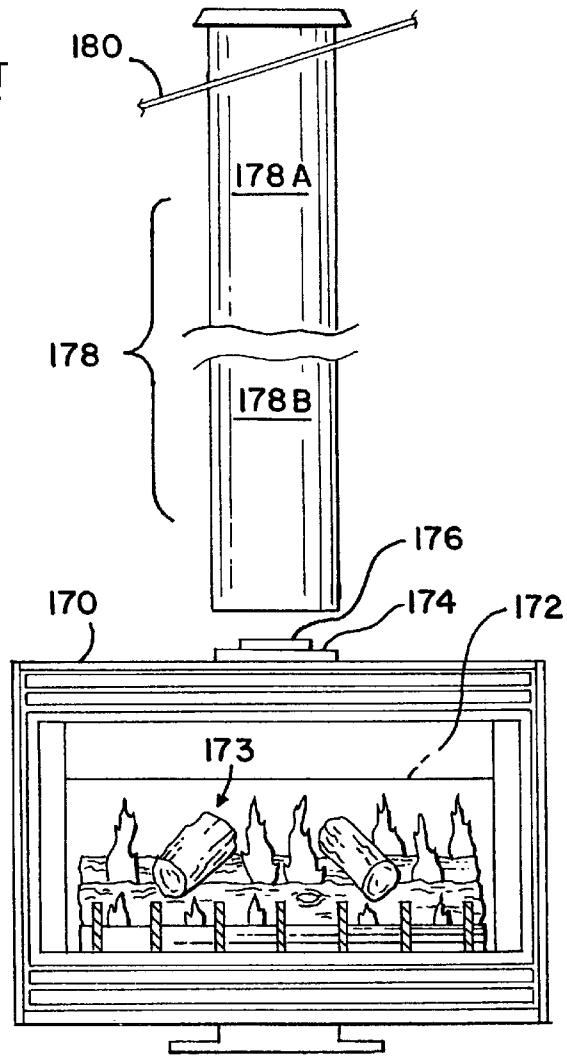
FIG. 1 PRIOR ART
FIG. 1 is a front elevational view showing a typical freestanding direct vent fireplace and a natural or B-vent flue.

Referring first to FIGS. 1 and 2, a typical freestanding direct venting fireplace is illustrated and is seen to include an outer housing generally designated at 170, in which a combustion chamber 172 is internally located. A burner assembly 173 is provided in the chamber and is comprised of a plurality of elongated artificial logs sitting on or above a burner which receives a regulated flow of fuel such as natural gas or propane. The direct vent unit, whether a fireplace, stove or other appliance, is of conventional design and further specific details will be omitted herein since the same is readily known and understood. While freestanding units are considered to be the most likely beneficiaries of the advantages of the present invention, in view of the accessibility of the vent stack and volume of room air to draw upon, it is conceivable that non-freestanding units may nevertheless benefit from an adaptation of the present embodiment yet remain within the scope of the invention.

The products of combustion (POC's) are conducted out of combustion chamber 172, upwardly to an exhaust gas vent pipe 176 that projects out of the top of the fireplace 170. The exhaust vent pipe 176 is interior to a collar 174, which is part of a fresh air introduction arrangement to bring air for combustion into the unit at combustion air inlet 175. A generally concentric flue pipe is therefore typically used with a direct vent unit of this type, which is usually circular in cross section and will extend from the vent pipe 176 to the exterior of the house 180.

FIG. 1, however, illustrates a natural or B-vent type of flue 178, schematically a multi-segmented structure with sections 178A and 178B. Such B-vent flues are well known and again, specific details thereof will be omitted. As will be set forth hereafter, the embodiment of the invention discussed herein is an adapter for conversion of the unit 170 to such a natural or B-vent stack 178.

The drafthood adapter assembly 10 of the present invention is incorporated into the vent stack as by removing a section 178B from stack 178, which is replaced by the assembly 10, since it is preferred that the present invention be installed as close to the unit 170 as possible. This facilitates connection of electronic sensors to the circuitry of fireplace 170, for example.

Air that contains oxygen necessary for supporting the combustion process would normally be communicated to the burner assembly 173 (through inlet feed 175) drawing from outside the dwelling. Furthermore, direct vent units which may have incorporated prior art drafthood adapters, require the removal of panels on the back or bottom of the unit in order to communicate air from within the room, to the burner assembly for combustion purposes. However, with the drafthood adapter assembly 10 of the present invention, combustion air will no longer be fed to the combustion chamber from outside the dwelling, nor will panels have to be removed from the unit. Instead, all of the air that is used for combustion, is provided solely through the drafthood adapter assembly 10 as will be explained in much greater detail below.

Figure 3:
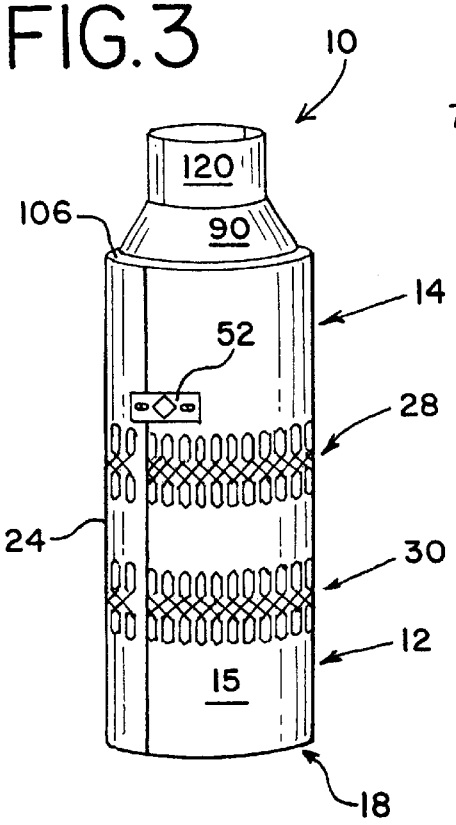
FIG. 3 is an isometric view of a drafthood assembly made in accordance with the present invention.
Figure 4:
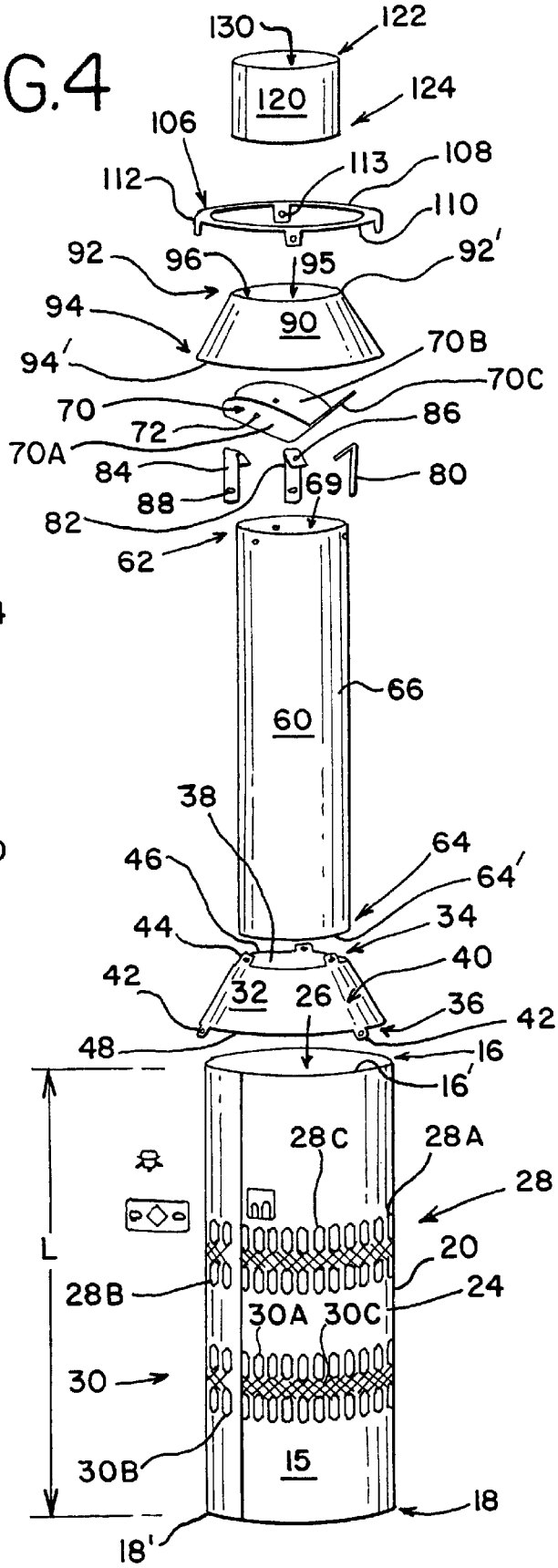
FIG. 4 is an exploded view of the drafthood assembly shown in FIG. 3.
Figure 5:
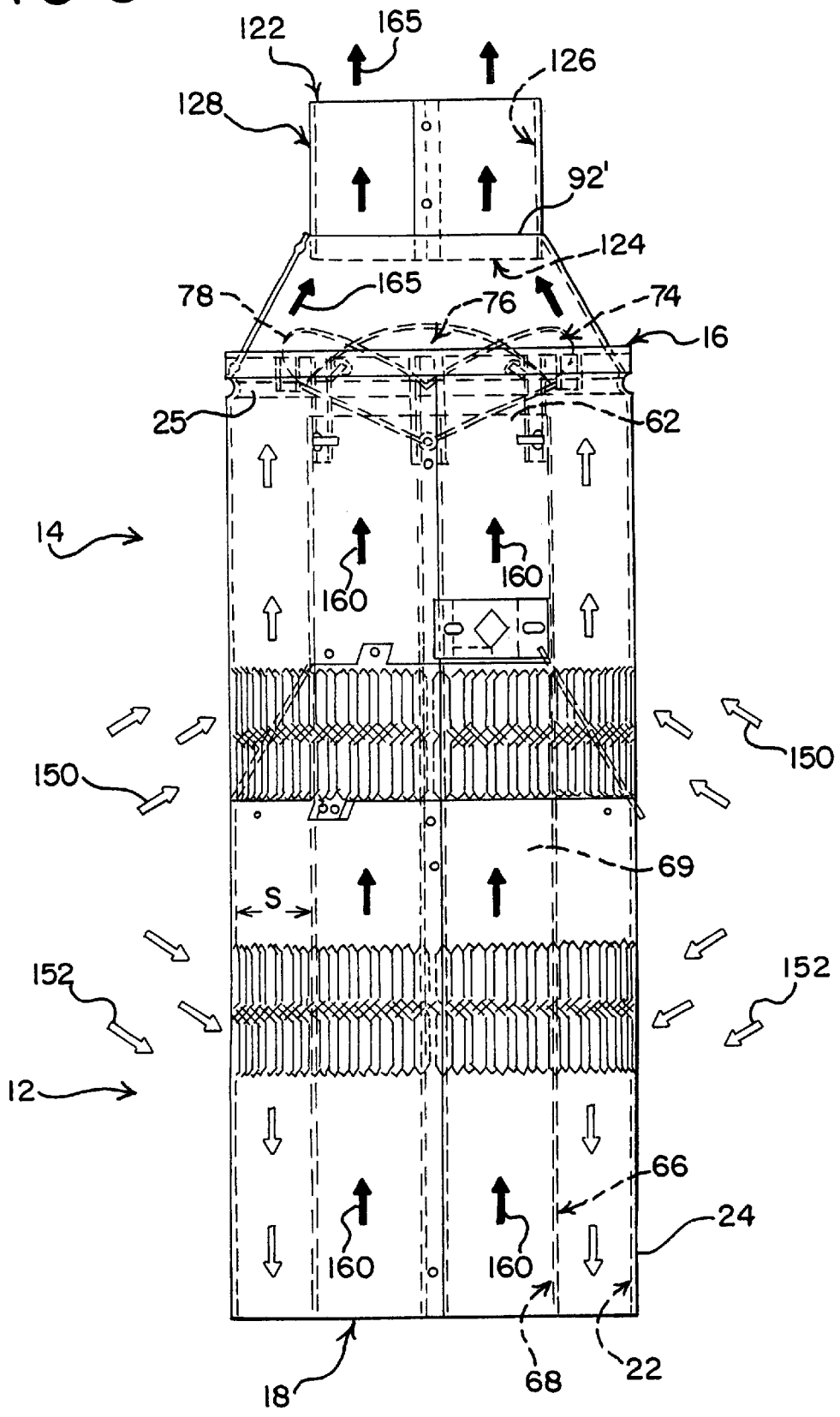
FIG. 5 is an enlarged view of FIG. 3 highlighting flows of air and combustion products.

Turning now to FIGS. 3–5, the drafthood adapter assembly 10 is comprised of two principal sections: an air intake section 12 and an exhaust gas section 14. The hollow exterior cylindrical shell 15, the hollow interior cylindrical exhaust pipe 60 and the interior conical deflector 32 are the base components of the assembly 10. The air intake or inlet section 12 functions by utilizing the ambient room air for combustion purposes, while the exhaust gas section 14 utilizes ambient room air to cool the POC's, as will now be explained.

The cylindrical hollow shell 15 is a thin-walled sheet metal member that longitudinally extends between a top end 16 and the bottom open end 18. The shell includes an exterior surface 24, interior surface 22, and the end edge surfaces 16' and 18'. An interior cavity 26 longitudinally extends between both ends.

The second cylindrically shaped, hollow exhaust pipe 60 is generally concentrically arranged within cavity 26, and includes a top open end 62 and a bottom open end 64, with a cavity 69 longitudinally extending therebetween. The exhaust pipe 60 has an interior surface 68, exterior surface 66 and a bottom edge surface 64' that is coextensive with the bottom edge surface 18' on shell 15. As seen, an annular space S (FIG. 5) is formed between the shell 15 and exhaust pipe 60.

A deflector member 32 (FIG. 4) is received over the exterior surface 66 of the exhaust pipe 60 and positioned within passage S so that a bottom edge 48 is located at about the midpoint 20 of shell 15 in this embodiment. The deflector member 32 divides the annular space S into two air intake sections; one below the deflector 32 (section 12), and the exhaust gas section which is essentially the annular space that is above the deflector 32 (section 14). Ambient room air identified by the large arrows at 150 (FIG. 5) will be fed into the exhaust gas section 14 to eventually cool the POC's traveling upwardly through the interior cavity 69 of exhaust pipe 60. The POC's are identified by the large, solid arrows referenced at 160. Likewise, ambient room air identified by the large arrows 152, will be fed into the air intake section to provide air for use within the combustion chamber 172. The inlet air section 12 and the exhaust gas section 14 being generally identified, will now be explained in greater detail.

In the inlet air section 12, a combustion air inlet opening 30 is comprised of a series of generally rectangularly configured slots 30A that have the longer sides of the rectangle vertically arranged, with each hole equidistantly spaced from the other in a radial fashion about the exterior surface 24 of cylindrical shell 15. Similarly, a bottom row of rectangularly-shaped holes 30B are arranged in vertical alignment with the holes 30A. Arranged in between the rows of holes 30A and 30B are holes 30C which are circularly configured. Holes 30C are also disposed between rows 30A and 30B so as not be in vertical alignment with the rectangular holes.

In the exhaust gas section 14, the upper, draft air inlet opening 28 is comprised of a set of similar openings 28A, 28B and 28C that are located slightly above the midpoint of the assembly at the level of the deflector 32. Other arrangements for the air opening structures may be readily used, however.

The deflector component 32 that separates the air intake section 12 from the exhaust gas section 14 comprises an open frustroconical deflector which is attached to the interior surface of cylindrical shell 15. This member includes top open end 34, the bottom open end 36, inside surface 38, and outside surface 40. The deflector 32 extends between an upper perimeter edge surface 46 and a lower perimeter edge surface 48. Radially-spaced tabs 42 and 44 are provided for attachment. The lower tabs 42 are integrally formed with the deflector 32, although they could be a separate component fastened to the outside surface 40. Likewise, upper tabs 44 extend upwardly away from upper perimeter edge 46 as an integral part of deflector 32, although they too can be attached as a separate component. Nevertheless, each tab group 42 and 44 will be provided with holes therein. The deflector 32 is rigidly attached to cylindrical shell 15 by inserting sheet metal screws or the like (not shown) through the holes, thereby attaching the member 32 in the desired location within the cavity of shell 15. Generally, the vertical height or extent of the deflector herein is about the same longitudinal distance the inlet opening occupies on the surface of the shell. The lower perimeter edge 48 is in close contact with interior surface 22 of cylindrical shell 15, so that the air 150 which is being introduced into opening 28 will move upwardly with respect to the longitudinal axis L of cylindrical shell 15. There may be insignificant amounts of air that filter downwardly between edge 48 and interior surface 22, but this is not considered detrimental since it combines with the air entering combustion air inlet 30.

As FIG. 5 also illustrates, the air which will be used for combustion purposes, herein designated at 152, will travel downwardly in the annular space existing between interior surface 22 of cylindrical shell 15 and exterior surface 66 of exhaust pipe 60, prior to entering the combustion air inlet opening 175 of the fireplace 170.

The exhaust pipe 60 is sized to be connected with vent pipe 176 on fireplace 170. The upper open end 62 is provided with radially-spaced brackets 80 that are secured to the interior surface 68 of the exhaust pipe (FIG. 4). Each bracket includes a vertical post member 84 integrally connected with an angled tab 82, which is downwardly directed. The downwardly directed tabs 82 each include a hole 86, while vertical posts 84 each include a hole 88. As best seen in FIG. 4, each bracket 80 is secured to the exhaust pipe 60 with sheet metal screws inserted within holes 88, so that a part of each bracket 80 extends longitudinally above open top end 62 an identical amount.

The tab sections 82 of each bracket 80 are secured to a baffle plate 70, which is formed of a first section 70A, a second section 70B and a third section 70C, each section having a generally triangular configuration. The baffle plate 70 also includes an outside surface 74 and an inside surface 76 (FIG. 5). Outside surface 74 is attached to the angled tabs 82, secured thereto by provision of holes 72 provided in each section so that a sheet metal screw can be inserted through the holes and into the respective holes 86 in each of the brackets 80.

The drafthood adapter assembly 10 also includes an open frustroconical reducer 90. The reducer 90 has a top open end 92, a bottom open end 94 and includes an inside surface 96 and an inside cavity 95. The reducer 90 further includes an upper perimeter edge surface 92' and a lower perimeter edge surface 94'. The lower perimeter edge surface 94' corresponds to the portion of the reducer having the larger diameter, while the upper perimeter edge 92' corresponds to the smaller diameter.

The reducer 90 is inserted into the interior cavity 26 of hollow shell 15 at the top, open end 16, and positioned with lower perimeter edge surface 94' making contact against an annular protuberance 25 formed in the top end 16 of the hollow shell 15. The protuberance 25 projects into cavity 26 only far enough so that the edge surface 94' rests on the protuberance and is supported by it. To ensure that a gas tight seal is formed between the protuberance and the reducer 90, a fire and heat resistant material is interposed between the protuberance 25 and the edge surface 94'. A preferred material consists of a fiberglass ribbon (not shown), although mattings having the same fire and heat resistant qualities could be used.

To assist in maintaining the fire resistant material and to aesthetically enclose the open, top end of the hollow shell 15, a reducer mounting bracket 106 is attached to the top end of shell 15. As FIG. 4 best shows, the mounting bracket is a metallic ring having a width defined by the distance between an interior edge surface 108 and the exterior edge surface 110. Integrally formed into exterior edge surface 110 are equidistantly spaced, downwardly projecting tabs 112 which are disposed at a 90 degree angle to the edge surface 110, each of which include a respective hole 113. The mounting bracket 106 is designed to be slid over the reducer 90 so that interior edge surface 108 is in resting contact against the outside surface of the reducer, causing the reducer 90 to be held tightly in place Within cavity 26 in cooperation with protuberance 25 once it is attached to the shell 15. FIG. 4 shows that the ring 106 is attached to the shell 15 by provision of sheet metal screws driven through holes 113 in each tab 112.

An upper exhaust pipe extension 120 is received within the interior cavity 95 of reducer 90 thereby completing this drafthood adapter assembly 10. The upper exhaust pipe extension 120 is also a hollow, cylindrically shaped component (e.g., FIG. 5) having a top, open end 122, a bottom open end 124, an interior surface 126, and exterior surface 128. An internal cavity 130 extends between ends 122 and 124, with the exterior surface 128 making frictional contact with the upper perimeter edge surface 92' of reducer 90. The upper exhaust pipe extension is inserted in and connected within the vent stack 178, as at a connection point at that bottom of section 178A, such that the drafthood assembly replaces vent stack portion 178B in its entirety. The extension pipe 120 finishes the gaseous, fluid communication between the exhaust vent pipe 176 on the fireplace, and the vent stack 178. For instance, vent stack 178 may oftentimes be a concentric tubular arrangement even in a B-vent flue, with an interior tube for the flue products and the outer tube providing an air-gap insulative space.

The operation of the drafthood adapter assembly of the present invention will now be explained in greater detail. As mentioned earlier, one object of the present adapter is to convert the direct venting stove or fireplace into a natural venting unit. Essentially, the present invention is designed to provide all of the air necessary for stoichiometric combustion solely through the drafthood adapter assembly without removing any panels from the unit and without "unsealing" the unit. Furthermore, the present invention is designed to cool the products of combustion to a temperature which satisfies the regulatory allowances for maximum temperatures that can be experienced by an approved "B-vent". However, it will be understood that the invention need not be used only in a retrofit arrangement, but could form part of an original installation.

The drafthood adapter assembly is initially inserted within the vent stack 178, as by replacing the lower section 178B (See FIG. 1). The bottom open end 64 of exhaust pipe 60 is connected to exhaust vent pipe 176, while the top open end 122 of the upper exhaust pipe extension 120 is connected to the bottom of an internal pipe in upper section 178A, where the flue is a concentric pipe arrangement, or simply located within the stack 178 (stack part 178A, for example, attaching at end 16). In this way, fluid communication is established between the combustion chamber 172 and the vent stack 178, so that all POC's can be expelled from the combustion chamber 172, to eventually reach roof 180. The bottom open end 18 of shell 15 is connected to the air intake pipe 174, so that combustion air inlet opening 175 is in fluid communication with the bottom air inlet opening 30.

A sensor assembly 52 includes a pair of wires (not shown) that are connected to a temperature sensor, and these wires are to be connected to circuitry of the fuel inlet control valve on the stove or fireplace. Those in the art are familiar with such inlet fuel control valves and circuitry, so that a detailed explanation is not necessary. The wires of the temperature sensor are preferably guided down the air intake section and then into the combustion air inlet opening on the fireplace 170, where they are then internally routed to the fuel inlet valve. Alternatively, the shell can be provided with a feed hole (not shown) near the bottom end of shell 15 and then routed through the feed hole, external of the drafthood adapter assembly for connection with the fuel inlet valve circuitry. The present invention is now physically connected and ready for operation. No part of the stove or fireplace needs to be modified in order to adequately feed the necessary volume of air into the combustion chamber, or vent the combustion products.

It is seen in FIG. 5 that ambient room air is split into two air stream sources, namely the air stream source 152 that will be dedicated strictly for combustion purposes, and the other air stream source 150 that will be added to and cool the POC's 160 that are being exhausted out of the stove or fireplace through the exhaust vent pipe 176 and up vent stack 178. Assuming that combustion is already proceeding, the combustion air stream 152 enters drafthood adapter assembly through the holes 30*a*, 30*b*, 30*c*, which comprise the combustion air inlet opening 30. The stream of air is prevented from traveling upwardly by deflector 32. Initially upon entering the air intake section, the air 152 strikes the exterior surface 66 of exhaust pipe 60, which is hot from the transfer of heat from the POC's 160 traveling upwardly within the interior cavity of exhaust pipe 60. The air 152 dedicated to combustion is thus slightly preheated before entering combustion air inlet opening 175, which feeds air into the combustion chamber 172.

Another important operating aspect of the present invention involves the use of a second ambient air feed into the drafthood adapter assembly for the purpose of cooling the POC's to temperatures that are suitable for use of a B-vent. By industry standards, the B-vent is suitable for use when temperatures of the exhaust gases will not exceed 480° F., making it much cheaper to incorporate a B-vent into the stove or fireplace unit since this type of vent stack does not have to be insulated. Direct vent stacks, on the other hand, are more expensive, and most of the time, a B-vent stack is already present.

As FIG. 5 best shows, ambient room air 150 is drawn into the drafthood adapter assembly 10 through the series of holes 28*a*, 28*b*, 28*c*, which comprise the top gas cooling air inlet 28. The air is prevented from traveling downward due to the deflector 32 blocking communication with the air intake section. As the air 150 enters the annular space between the shell 15 and the exhaust pipe 60, the air initially strikes the exterior surface 66 of exhaust pipe 60, causing the relatively much cooler air 150 to retain some of the heat that is indirectly transferred from the POC's 160 which are traveling upwardly within the interior cavity 69. As the air 150 continues upwardly and concurrent with the direction of the POC's 160, the air 150 enters into the upper part of the exhaust gas section 14, where it directly mixes with the POC's 160 to dilute the hot gases with the much cooler air 150, thereby forming the mixed gas 165. This part of the exhaust gas section generally begins near the top end 16 of shell 15 and is considered to be a mixing chamber area for the hot gases and cooler room air, or transition assembly. The transition assembly is comprised of the reducer 90, baffle 70 and the upper exhaust pipe extension 120. As FIG. 5 shows, the top, open end 62 of the exhaust pipe 60 is arranged to terminate slightly below the top edge 16' of hollow shell 15. By exiting at the location shown, the hot gases 160 will first strike the outer surface 74 of the baffle plate 70 and be directed towards the interior wall surface 24 of hollow shell 15, and initially mix with the air 150 also flowing upwardly along the interior wall surface 24. The baffle plate 70 is seen to have the three triangular sections extending within the interior cavity 95 at the bottom end 94, thereby causing turbulent mixing and turbulent flow as the mixed gas 165 now continues upward. However, further mixing of the mixed gases 165 will occur within the reducer 90, when the air stream profiles flowing over the perimeter edges 78 of the baffle plate 70 are forced to converge toward and against one another as the reducer diameter narrows to its smallest diameter at the top 92. The mixed gases 165 enter the upper exhaust pipe extension cooled to a temperature in a typical set-up in the range of between 300–450° F. The range of temperatures is dependent upon the type of fuel used for combustion, natural gas or propane, among other things. Finally, it is seen that the cooled mixed gas 165 exits the top end 122 of exhaust pipe extension 120, discharging into the vent stack 178, where it continues upwardly until being discharged at roof 180, as depicted in FIG. 1.

While the apparatus and methods herein disclosed form a preferred embodiment of this invention, it will be understood that this invention is not so limited, and changes can be made without departing from the scope and spirit of this invention, which is defined in the appended claims.

What is claimed is:

1. An apparatus for converting a direct vent appliance located in a room to operate with a natural vent flue including a vent stack for exhausting products of combustion (POC's) from a combustion chamber of the appliance, comprising:

a drafthood assembly insertable into the vent stack, the drafthood assembly including an air intake section and an exhaust gas section, the exhaust gas section being positioned about a length of an exhaust pipe, each of the air intake section and the exhaust gas section being fluidly isolated from the other;

wherein the air intake section introduces room air into the appliance for combustion and the exhaust gas section introduces room air into the vent stack to cool POC's exhausted from the appliance.

2. The apparatus of claim 1, wherein the exhaust pipe communicates POC's from the combustion chamber to the vent stack.

3. The apparatus of claim 2, wherein the drafthood assembly further comprises a hollow cylindrical shell having an interior cavity and being generally concentrically arranged about the exhaust pipe so as to define an annular passageway between the shell and exhaust pipe, with a deflector inserted within the passageway dividing the passageway to form the air intake section and the exhaust gas section, the air intake section located below the exhaust gas section.

4. The apparatus of claim 3, wherein the cylindrical shell includes two sets of longitudinally spaced air inlet openings, one set of openings located above the deflector and the other set of openings located below the deflector, each set of openings conducting ambient-air in the room into the respective air intake and exhaust gas sections.

5. The apparatus of claim 4, wherein the air that enters the intake section initially contacts the exhaust pipe to become preheated prior to input within the combustion chamber.

6. The apparatus of claim 4, wherein the exhaust gas section has a first part and a second part, whereupon in the first part, the air that enters the drafthood assembly through the exhaust gas section initially contacts the exhaust pipe to cool the exhaust pipe, thereby cooling POC's within the exhaust pipe, and whereupon in the second part, the air from the first part continues upwardly therein and mixes with the POC's prior to entry into the vent stack.

7. The apparatus of claim 6, wherein the hollow exhaust pipe has first and second open ends corresponding to and generally coextensive with the top and bottom ends of the shell, the top end of the shell having a transition assembly secured thereabout, the transition assembly defining the second part of the exhaust section, the transition assembly forming a mixing area where air mixes with the POC's exiting the exhaust pipe.

8. The apparatus of claim 7, wherein the transition assembly comprises a reducer having a top and a bottom end, and an upper exhaust pipe extension having a top and a bottom end, the bottom end of the upper exhaust pipe extension connected to the top end of the reducer, the reducer spanning the annular passageway and forming a neck for directing air into and through the second part and into the upper exhaust pipe extension.

9. The apparatus of claim 8, wherein the top end of the shell includes a protuberance directed towards the interior cavity thereof, the bottom end of the reducer resting on top of the protuberance.

10. The apparatus of claim 9, wherein a fireproof seal is disposed between the shell and transition assembly to prevent POC's from entering the air in the room.

11. The apparatus of claim 10, wherein a cap ring encloses the top end of the hollow shell, an interior edge surface of the cap ring contacts the outside surface of the reducer, and an exterior edge surface of the cap ring contacts the interior surface of the shell.

12. The apparatus of claim 11, wherein the transition assembly further comprises a baffle plate disposed within the mixing area, the baffle plate causing turbulent mixing of the POC's and air-prior to entry into the vent stack.

13. The apparatus of claim 12, wherein the baffle plate is formed with three identical, upturned sections for deflecting all of the POC's exiting the top end of the exhaust pipe towards the interior surface of the shell.

14. The apparatus of claim 13, wherein the baffle plate has a perimeter edge and each upturned section has a generally triangular shape, the perimeter edge of each section being arcuately formed.

15. The apparatus of claim 14, further including a sensor assembly projecting into the first part of the exhaust gas section, the sensor assembly measuring the temperature of the POC's.

16. The apparatus of claim 4, wherein the direct vent appliance is a freestanding appliance.

17. A direct vent appliance, which is adapted to operate using a B-vent flue having a vent stack through which exhaust gas products of combustion in the appliance are vented, comprising:

a drafthood assembly in the vent stack, said drafthood assembly having an air intake section and an exhaust gas section, said air intake section forming a passage for air in a space within which the appliance is located to enter the appliance for combustion, and said exhaust gas section forming a passage for ambient air to enter the vent stack to be vented with the exhaust products.

18. The appliance of claim 17, wherein ambient air in said air intake section is isolated from ambient air in said exhaust gas section.

19. The appliance of claim 18, wherein said drafthood assembly further comprises an exhaust pipe communicating with an outlet in the appliance for exhaust products from combustion within the appliance, an ambient air pipe surrounding said exhaust pipe forming a passageway for ambient air, a divider separating said passageway into said air intake section and said exhaust gas section, said air intake section communicating with an inlet in the appliance for ambient air to enter the appliance for combustion, and ambient air ingress openings in said ambient air pipe in both said air intake and exhaust gas sections.

20. The appliance of claim 19, wherein said air and exhaust pipes are elongated tubes which are generally concentrically arranged, said exhaust pipe having an open part in said exhaust gas section through which exhaust gas products can communicate and combine with ambient air in said exhaust gas section, said air ingress openings in said exhaust gas section being located adjacent said divider.

21. The appliance of claim 20, wherein said open part of said exhaust gas section is an element of a transition assembly in said drafthood assembly, said transition assembly having a baffle located adjacent said open part of said exhaust pipe, said baffle directing exhaust gas products into said passageway, and a reducer member merging said passageway and said exhaust pipe into a single vent pipe in the vent stack.

22. The appliance of claim 21, wherein said divider has a frustoconical shape with a wide internal diameter and a short internal diameter, the wide internal diameter being located adjacent said air pipe, and said elongated tubes have a coextensive length below said divider to preheat said ambient air in said air intake section.

23. The appliance of claim 22, wherein said drafthood assembly is provided as a pre-assembled adapter having a unitary structure for interconnection of a direct vent appliance with a B-vent flue.

24. The appliance of claim 17, wherein the direct vent appliance is a freestanding appliance.

* * * * *